United States Patent [19]

Davis

[11] Patent Number: 5,037,098

[45] Date of Patent: Aug. 6, 1991

[54] TENNIS RACQUET WITH TAPERED PROFILE FRAME

[75] Inventor: Stephen J. Davis, New Hope, Pa.

[73] Assignee: Prince Manufacturing, Inc., Lawrenceville, N.J.

[21] Appl. No.: 478,065

[22] Filed: Feb. 7, 1990

Related U.S. Application Data

[63] Continuation of Ser. No. 178,255, Apr. 6, 1988, abandoned.

[51] Int. Cl.[5] ..... A63B 49/02

[52] U.S. Cl. ..... 273/73 C

[58] Field of Search ..... 273/73 R, 73 C, 73 F, 273/73 G, 73 H, 73 K, DIG. 23

[56] References Cited

U.S. PATENT DOCUMENTS

| | | | |
|---|---|---|---|
| 243,467 | 2/1977 | Kouvelas . | |
| 1,539,019 | 2/1924 | Nikonow . | |
| 2,164,631 | 1/1937 | Abell . | |
| 2,171,223 | 8/1939 | Robinson . | |
| 3,647,211 | 3/1972 | Doessel et al. . | |
| 3,755,037 | 8/1973 | Erwin et al. | 273/73 FX |
| 3,809,402 | 5/1974 | Haines et al. . | |
| 3,930,920 | 1/1976 | Kicherer | 273/73 FX |
| 4,177,990 | 12/1979 | Kajiwara | 273/73 C |
| 4,280,699 | 7/1981 | Drake | 273/73 C |
| 4,291,574 | 9/1981 | Frolow . | |
| 4,293,129 | 10/1981 | Planakis . | |
| 4,294,787 | 10/1981 | Lo | 273/73 FX |
| 4,561,655 | 12/1985 | Mortvedt | 273/73 C |
| 4,664,380 | 5/1987 | Kuebler | 273/73 C |

FOREIGN PATENT DOCUMENTS

| | | | |
|---|---|---|---|
| 298874 | 10/1928 | United Kingdom | 273/73 C |
| 2103667 | 2/1983 | United Kingdom | 273/73 C |

*Primary Examiner*—Edward M. Coven
*Assistant Examiner*—William E. Stoll
*Attorney, Agent, or Firm*—White & Case

[57] ABSTRACT

A tennis racquet includes a hollow tubular frame defining a head portion, a throat, and a shaft portion supporting a handle. The frame has a height, in a direction perpendicular to the stringing plane, that increases uniformly from the bottomn of the throat to the tip of the head portion, so as to increase in stiffness further away from the handle. Such arrangement, in which the frame is most flexible at the top of the handle, reduces the angle of deflection of the stringing plane upon impact and absorbs shock.

20 Claims, 2 Drawing Sheets

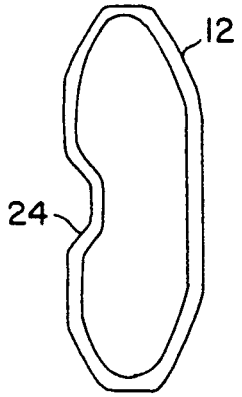
FIG. 3
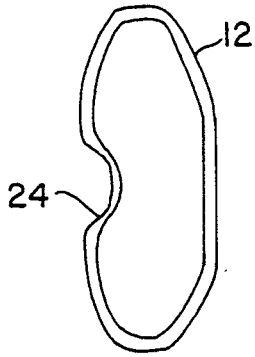
FIG. 4
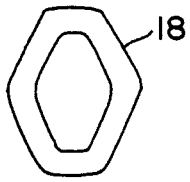
FIG. 5
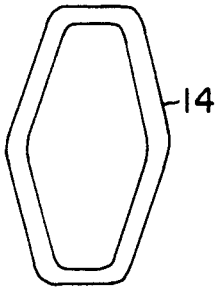
FIG. 6
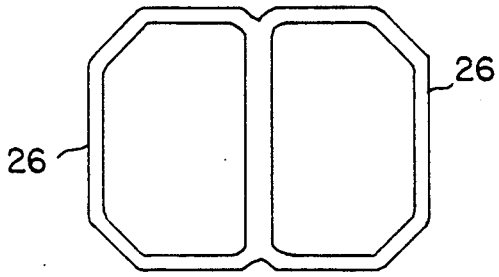
FIG. 7
FIG. 8
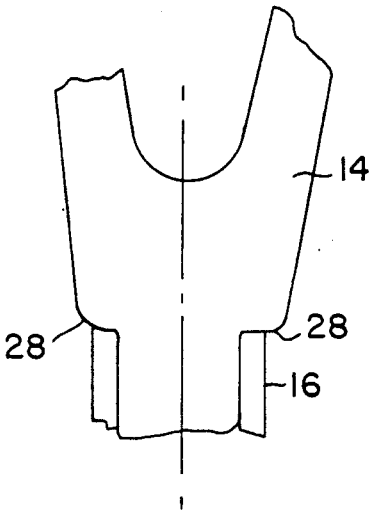

TENNIS RACQUET WITH TAPERED PROFILE FRAME

This application is a continuation of application Ser. No. 178,255, filed on Apr. 6, 1988, now abandoned.

FIELD OF INVENTION

The present invention relates to sports rackets of the type having a handle and a head portion with strings, with particular application to tennis rackets.

BACKGROUND OF THE INVENTION

In conventional tennis rackets, the head and throat portions of the frame are more or less of a uniform height, typically about 19 mm for a graphite frame, the term "height" referring herein to the dimension perpendicular to the plane of the racket strings. The height of the shaft portion may or may not be the same as the head and throat, but in any event a handle is formed on the shaft which has a larger dimension.

When the ball is hit, the resulting impact produces bending in the racket frame, about the handle where the racket is gripped. The amount of racket deflection depends upon the particular racket construction, e.g. cross-sectional shape and thickness, as well as the materials used. Variations of dimension or wall thickness, at different areas of the frame, can also affect the bending profile. Thus, a frame having a uniform cross-section produces a characteristic bending profile at various longitudinal positions along the frame. Recently, several rackets have been introduced which vary the height of the frame along the racket so as to alter this characteristic profile in various ways.

Kuebler U.S. Pat. No. 4,664,380 discloses several racket configurations in which the height of the frame is greatest in the throat area i.e., the middle portion of the racket, decreasing toward the top of the racket. The height in the throat area is also greater than the height of the racket handle. As described by Kuebler, increasing the height in the throat, as opposed to a conventional, uniform height frame, moves the center of percussion of the racket so as to match the vibration frequency of the racket to that of the ball.

Other rackets, such as the Revolutive Apollo, as well as rackets sold by Donnay, Vokyl, and Head use thinner and thicker sections along the racket so as to move the centers of vibration and change the response of the racket. These rackets then attempt to improve the power performance and response.

SUMMARY OF THE INVENTION

The present invention is a sports racket, preferably a tennis racket, with a novel frame profile configured to improve the response and accuracy of the racket for balls that are hit off center, toward the tip of the racket.

More particularly, a racket according to the present invention has a frame in which the cross-sectional height of the racket increases linearly from the top of the handle to the top of the frame, thus increasing the stiffness of the frame toward the tip of the racket. Whereas conventional frames deflect more as the ball is hit further out from the handle, because the moment load is higher, a frame according to the invention provides greater stiffness at the tip of the racket to deflect less. Less energy is lost on such off center hits, resulting in a more powerful racket overall.

In addition, because the stiffness of the frame decreases toward the handle, deflection which would otherwise occur in the head area is redirected toward the handle to a point of minimum stiffness, above the handle area. As a result, because the head area remains more rigid, a more uniform ball response occurs on the string plane. In addition, the angle of frame deflection is reduced because the deflection point is farther away from the strike zone than in conventional rackets, which by geometry reduces the angle by which the stringing plane deflects upon impact. This means that better control can be maintained.

The novel structure of the present invention produces yet another benefit as compared to conventional frame structures. Because the main deflection point is relocated to a point between the striking area and the handle, the frame absorbs more of the shock load resulting from the ball impact hence transmitting less to the arm and providing a more comfortable and cushioned hit.

For a better understanding of the invention, reference is made to the following detailed description of a preferred embodiment, taken in con]unction with the drawings accompanying the application.

BRIEF DESCRIPTION OF THE DRAWINGS

FIG. 3, 4, 5, and 6 are sectional views taken through lines 3—3, 4—4, 5—5, and 6—6 of FIG. 1, respectively;

FIG. 7 is a sectional view taken through lines 7—7 of FIG. 2; and FIG. 8 is an enlarged front view of a portion of the shaft.

DETAILED DESCRIPTION OF A PREFERRED EMBODIMENT

Figure 2:
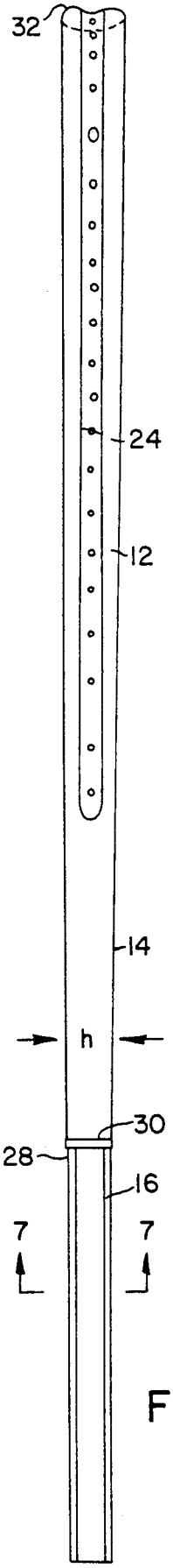
FIG. 2 is a side view of the frame of FIG. 1 prior to mounting a handle on the shaft.
Figure 1:
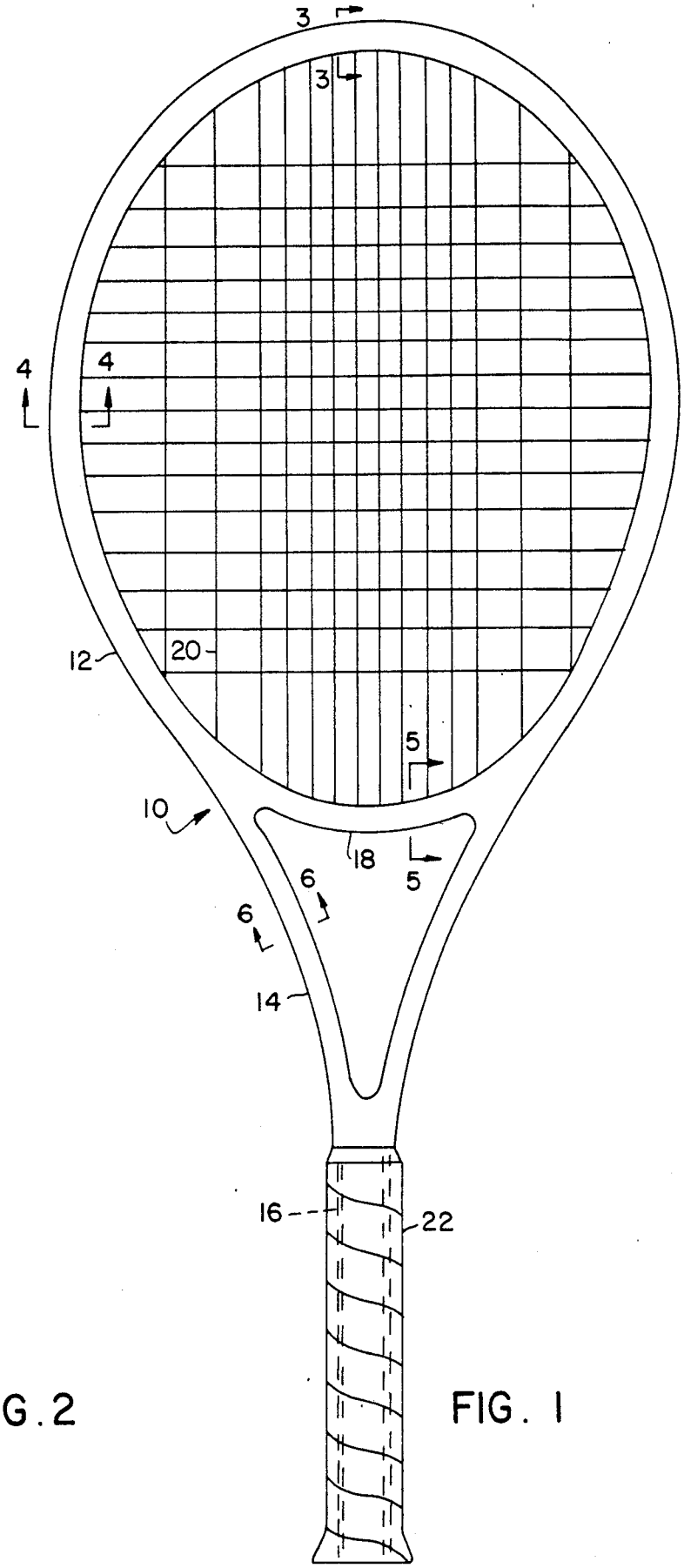
FIG. 1 is a front view of a tennis racket according to the invention.

FIGS. 1–8 show a tennis racket constructed according to the invention, which includes a frame 10 defining a head portion 12, a throat area 14 formed by opposite legs of the frame, and a shaft portion 16. The frame also includes a throat bridge 18 that, together with head portion 12, defines a generally elliptical area for supporting strings 20. A handle 22 is provided on the shaft portion in a selected grip size.

As shown in FIG. 2, which illustrates the frame 10 without the handle 22 or strings 20, the outwardly facing side of the head portion 12 is provided with a stringing groove 24 as well as a plurality of holes 26 for the strings. The holes and strings shown in FIGS. 1 and 2, as well as the spacing thereof, are merely for purposes of illustration. Preferred string arrangements are well known, and the particular arrangement employed does not form part of the invention.

FIGS. 2, 7, and 8 illustrate a preferred shaft cross-sectional profile, in which opposing legs 26 of a tubular frame member are molded so as to define a generally rectangular shaft portion of axially uniform dimension, the shaft portion ending in a shoulder 28. In this manner, the handle portion may be constructed as a preformed sleeve member which slides onto shaft 16, abutting against shoulder 28, and is adhered thereon, in the manner described more fully in commonly owned U.S. patent applicant Ser. No. 069,060, filed July 2, 1987. Alternatively, the handle may be formed on the shaft portion 16 in the conventional manner.

As shown in FIG. 2, the height h, that is, the height in a direction perpendicular to the plane of the strings 20, increases uniformly from the top 30 of the shaft portion 16 (top of handle 22) to the tip 32 of the frame, where it is a maximum. In an illustrative embodiment, the height h at the shaft portion top 30 is approximately 19 mm, increasing linearly, in the longitudinal direction, to a height of 28 mm at the racket tip 32. An illustrative racket has an overall length of 683 mm, with a shaft 16 of 187 mm, head 12 being about 356 mm in length and 263 mm in maximum width. The width of the frame member is approximately 10 mm in the head 12 and bridge 18 and 11 mm in the throat.

A racket according to the invention is preferably made of tubular fiber-impregnated resin, such as graphite, and constructed using known processes for making such rackets. According to such processes, strips of uncured graphite are rolled into an elongated cylindrical, main tube which is placed in a mold, in a manner known, together with the bridge piece 18. The tubular layup is then heated and cured in the mold, while the interior of the main tubular member is internally pressured to conform it to the mold, e.g. to form stringing groove 24.

FIGS. 3–7 illustrate cross-sectional profiles taken at various locations on the frame which, as in the case of FIG. 8, are enlarged views. As shown, the wall thickness of the profiles in the head 12 throat 14, are approximately constant; however the height becomes progressively greater toward the tip 32.

In view of the increasing height from the top 30 of the handle 22 to the top 32, the frame stiffness increases in the direction of the racket tip 32. Accordingly, upon impact the head portion remains stiff, and bending occurs more toward the handle 22, in the throat 14. Deflection of the head and stringing plane thereby occurs with less of an angular rotation relative to the handle, producing better accuracy. At the same time, because the head deflects about a point nearer the handle, shock of impact is absorbed in the frame reducing the amount transmitted to the arm. In addition, because the head is stiffer toward the tip, off center hits, i.e. near the outer portion of the racket, occur with less energy loss and therefore greater power.

The racket shown will produce a frame four times stiffer at the tip of the head than the minimum thickness area. It is possible to vary these relative stiffnesses, for example, to provide a frame up to eight times stiffer at the head than at the top of the handle, by appropriately changing the heights of the profile, the thickness of the walls, or the stiffness of materials in different sections of the racket. For example, without limitation it is presently contemplated that rackets may be given profile thicknesses (heights) within a range of 10 to 40 mm.

A racket according to the invention provides an area of minimum stiffness just above the handle. Because the frame is stiffer everywhere else, the moment load upon ball impact is greatest in the minimum thickness (height) area which causes deflection to be centered there. This deflection of the frame results in shock absorption. At the same time, because the area around which deflection is centered is relatively far removed from the string area, the angle of deflection of the string plane remains small imparting a truer direction to hits.

The foregoing represents a preferred embodiment of the invention. Variations and modifications of the embodiment shown and described therein will be apparent to persons skilled in the art, without departing from the inventive concepts disclosed herein. For example, while a racket has been described formed of tubular fiber-impregnated materials, the invention may be applied to other materials such as metals, and other cross-sectional profiles. Also, it is possible to vary the cross-sectional wall thickness in the frame, or heights to increase stiffness, as noted above. All such modifications and variations are intended to be within the scope of the invention as defined in the following claims.

I claim:

1. A sports racket comprising:

a frame defining a head portion for supporting strings in a stringing plane, a shaft portion, and a throat portion; wherein the throat portion has a lower portion joining said shaft portion and wherein the head portion has a tip lying furthermost from said shaft portion;

a plurality of strings supported in tension by said head portion so as to lie in said stringing plane; and a handle on said shaft portion, wherein the head portion and throat portion of the frame have a height, in a direction perpendicular to said stringing plane, which is at a minimum at the lower portion of the throat portion and which increases continuously and smoothly to a maximum at said tip, for progressively increasing the racket stiffness along the frame toward the tip, such that balls hit in the outer portion of the frame rebound with less energy loss and greater accuracy, and wherein said head portion has a width which remains at least approximately constant.

2. A sports racket according to claim 1, wherein the frame has a longitudinal axis and wherein said height increases linearly along said axis.

3. A sports racket according to claim 2, wherein the frame height in said head and throat portions is substantially greater than the frame width.

4. A sports racket according to claim 3, wherein said frame is formed of an elongated hollow tubular member.

5. A sports racket according to claim 4, wherein said head portion and throat portions have a wall thickness that remains approximately constant.

6. A sports racket according to claim 5, wherein said frame is formed of a fiber-impregnated resin.

7. A sports racket as defined in claim 6, wherein the height of said frame increases from about 19 mm at the throat lower end to about 28 mm at the tip.

8. A sports racket comprising:

a hollow tubular frame, formed of a fiber-impregnated resin material, defining a head portion for supporting strings in a stringing plane, a shaft portion, and a pair of throat portions connecting said shaft portion and said head portion, and wherein the head portion has a tip lying furthermost from said shaft portion;

a plurality of strings supported in tension by said head portion so as to lie in said stringing plane; and a handle on said shaft portion, wherein the head portion and throat portions have a wall thickness that remains, at least approximately, constant, and wherein the head portion and throat portions of the frame have a height, in a direction perpendicular to said stringing plane, which is at a minimum at the lower portion of the throat portion and which increases continuously and smoothly to a maximum at said tip, for progressively increasing the racket stiffness along the frame toward the tip, such that balls hit in the outer portion of the frame rebound with less energy loss and greater accuracy.

9. A sports racket according to claim 8, wherein the frame has a longitudinal axis and wherein said height increases linearly along said axis.

10. A sports racket as defined in claim 8, wherein said frame has a width, in said head and throat portions, that is substantially less than the height.

11. A tennis racket frame comprising a head portion for supporting strings in a stringing plane, a shaft portion, and a throat portion; wherein the throat portion has a lower portion joining said shaft portion and wherein the head portion has a tip lying furthermost from said shaft portion;

a handle on said shaft portion, wherein the head portion and throat portion of the frame has a height, in a direction perpendicular to said stringing plane, which is at a minimum at the lower portion of the throat portion and which increases continuously and smoothly to a maximum at said tip, for progressively increasing the racket stiffness along the frame toward the tip, such that balls hit in the outer portion of the frame rebound with less energy loss and greater accuracy, and wherein said head portion has a width which remains at least approximately constant.

12. A tennis racket frame according to claim 10, wherein the frame has a longitudinal axis and wherein said height increases linearly along said axis.

13. A tennis racket frame according to claim 12, wherein the height in said head and throat portions is substantially greater than the width.

14. A tennis racket frame according to claim 13, wherein said frame is formed of a elongated hollow tubular member.

15. A tennis racket frame according to claim 14, wherein said head portion and throat portions have a wall thickness that remains approximately constant.

16. A tennis racket frame according to claim 15, wherein said frame is formed of a fiber-impregnated resin.

17. A tennis racket frame as defined in claim 16, wherein the height of said frame increases from about 19 mm at the throat lower end to about 28 mm at the tip.

18. A tennis racket frame comprising:

a hollow tubular frame, formed of a fiber-impregnated resin material, defining a head portion for supporting strings in a stringing plane, a shaft portion, and a pair of throat portions connecting said shaft portion and said head portion, and wherein the head portion has a tip lying furthermost from said shaft portion;

a handle on said shaft portion, wherein the head portion and throat portions have wall thicknesses that remain, at least approximately, constant, and wherein the head portion and throat portions of the frame have a height, in a direction perpendicular to said stringing plane, which is at a minimum at the lower portion of the throat portion and which increases continuously and smoothly to a maximum at said tip, for progressively increasing the racket stiffness along the frame toward the tip, such that balls hit in the outer portion of the frame rebound with less energy loss and greater accuracy, and wherein said head portion has a width which remains at least approximately constant.

19. A tennis racket frame according to claim 18, wherein the frame has a longitudinal axis and wherein said height increases linearly along said axis.

20. A tennis racket frame according to claim 19, wherein the frame member has a width in said head and shaft portions that is substantially less then the height.

* * * * *